United States Patent [19]

Takase et al.

[11] 4,132,193

[45] Jan. 2, 1979

[54] EXHAUST GAS TEMPERATURE DETECTION FOR FUEL CONTROL SYSTEMS

[75] Inventors: Sadao Takase, Yokohama; Masaharu Asano; Tadashi Nagai, both of Yokosuka, all of Japan

[73] Assignee: Nissan Motor Company, Limited, Japan

[21] Appl. No.: 795,150

[22] Filed: May 9, 1977

[30] Foreign Application Priority Data

May 10, 1976 [JP] Japan ..... 51/52104

[51] Int. Cl.[2] ..... F02B 3/08; F02M 7/12

[52] U.S. Cl. ..... 123/32 EE; 123/119 EC; 60/276; 60/285

[58] Field of Search ..... 123/32 EE, 32 EA; 60/276, 285; 364/431

[56] References Cited

U.S. PATENT DOCUMENTS

| | | | |
|---|---|---|---|
| 3,745,768 | 7/1973 | Zechnall et al. | 123/32 EE |
| 3,938,075 | 2/1976 | Reddy | 60/285 |
| 3,938,479 | 2/1976 | Oberstadt | 123/32 EE |

FOREIGN PATENT DOCUMENTS

| | | | |
|---|---|---|---|
| 2311180 | 10/1976 | France | 60/285 |

*Primary Examiner*—Charles J. Myhre
*Assistant Examiner*—P. S. Lall
*Attorney, Agent, or Firm*—Lowe, King, Price & Becker

[57] ABSTRACT

An exhaust gas sensor is provided to generate a signal representing the air-fuel ratio within the exhaust system. The deviation of the air-fuel ratio from the average value of the sensor output is detected by a comparator. The time integral value is momentarily offset when the sensor reaches its operating temperature range so that the output from the comparator takes a definite value for quickly starting closed control operation.

7 Claims, 5 Drawing Figures

EXHAUST GAS TEMPERATURE DETECTION FOR FUEL CONTROL SYSTEMS

FIELD OF THE INVENTION

The present invention relates in general to the reduction of undesirable substances in the exhaust gases of internal combustion engines, and in particular to a detection system for detecting when an exhaust gas sensor reaches its operating temperature range to start closed control operation.

BACKGROUND OF THE INVENTION

It is well known in the art that the types and amounts of substances present in engine exhaust is greatly affected by the ratio of air to fuel in the mixture supplied to the engine. Rich mixtures, with excess fuel, tend to produce higher amounts of hydrocarbons and carbon monoxide, whereas lean mixtures, with excess air, tend to produce greater amounts of oxides of nitrogen. It is also known that exhaust gases can be catalytically treated to reduce the amounts of these undesirable components when the air fuel contents of the exhaust gases is maintained within a narrow range of ratios. The catalytic treatment of gases is achieved by a three-way catalytic converter provided that the air-fuel mixture supplied to the catalytic converter is maintained within the narrow range, termed the "converter window". However, this converter window is too narrow to be maintained by an conventional open loop fuel control system, and conversion efficiency drops dramatically for the different undesirable exhaust constituents on either side of the window.

A closed loop fuel control system has been suggested which can maintain the gases supplied to the catalytic converter within the narrow range by a feedback signal from a zirconia sensor exposed to the exhaust gases. However, the design of such a control system must meet a number of requirements. The system must be stable to maintain continual control and not go into oscillation. On the other hand, the system must be quick reacting and characterized by small overshoot, so that the minimum time is spent outside of the converter window.

The zirconia sensor provides an electrical signal representative of the concentration of the oxygen in the exhaust gases. However, this sensor is temperature dependent since its internal impedance is extremely high when the exhaust temperature is low so that the output delivered from the sensor with the engine under cold start remains at low voltage level. Under these circumstances, it is desirable to suspend the closed control operation. It is also desirable to resume feedback control so soon as the temperature of the exhaust gases warrants feedback control.

It is disclosed in Co-pending U.S. patent application Ser. No. 767,133 filed on Feb. 9, 1977 that, in a closed fuel control system, the output from the exhaust gas sensor is compared with a signal representative of the time integral of the sensor output and generates a signal representative of the deviation of the air-fuel ratio in the exhaust system from the time integral or average value of its ratio. Such time integration of the sensor output serves to compensate for the changing characteristics of the sensor with its temperature and aging. However, this time integral signal should be clamped so that its minimum voltage level corresponds to a level that represents the operating temperature of the sensor so that under cold start operation the time integral signal is prevented from going extremely low. Since under these circumstances the output from the exhaust gas sensor rises almost at the same rate as the rate at which the time integral signal rises for a certain interval of time until closed fuel control operation becomes effective, the result of the comparison between the two input variables is indeterminate as long as they take equal values though the sensor's operating temperature is reached. Therefore, the deviation of the air-fuel ratio from its time integral value is uncertain for a certain period of time and closed control operation cannot be quickly commenced.

SUMMARY OF THE INVENTION

In the fuel control system of the invention, an exhaust gas sensor is provided to deliver an output representative of the air-fuel ratio in the exhaust system and compared with its time integral value. When the sensor reaches its operating temperature range, the time integral representative signal is momentarily offset so that the difference between the input variables to the comparator increases to provide a definite output for starting the operation of closed loop control.

It is the principal object of the invention to provide an air-fuel control system for an internal combustion engine which is capable of quickly starting its closed control operation as soon as the sensor temperature reaches its operating range.

It is another object of the invention to minimize the undesirable exhaust gases when the engine is under cold start operation.

DESCRIPTION OF THE DRAWINGS

The invention will be further described with reference to the accompanying drawings, in which.

DESCRIPTION OF THE PREFERRED EMBODIMENT

Figure 1:
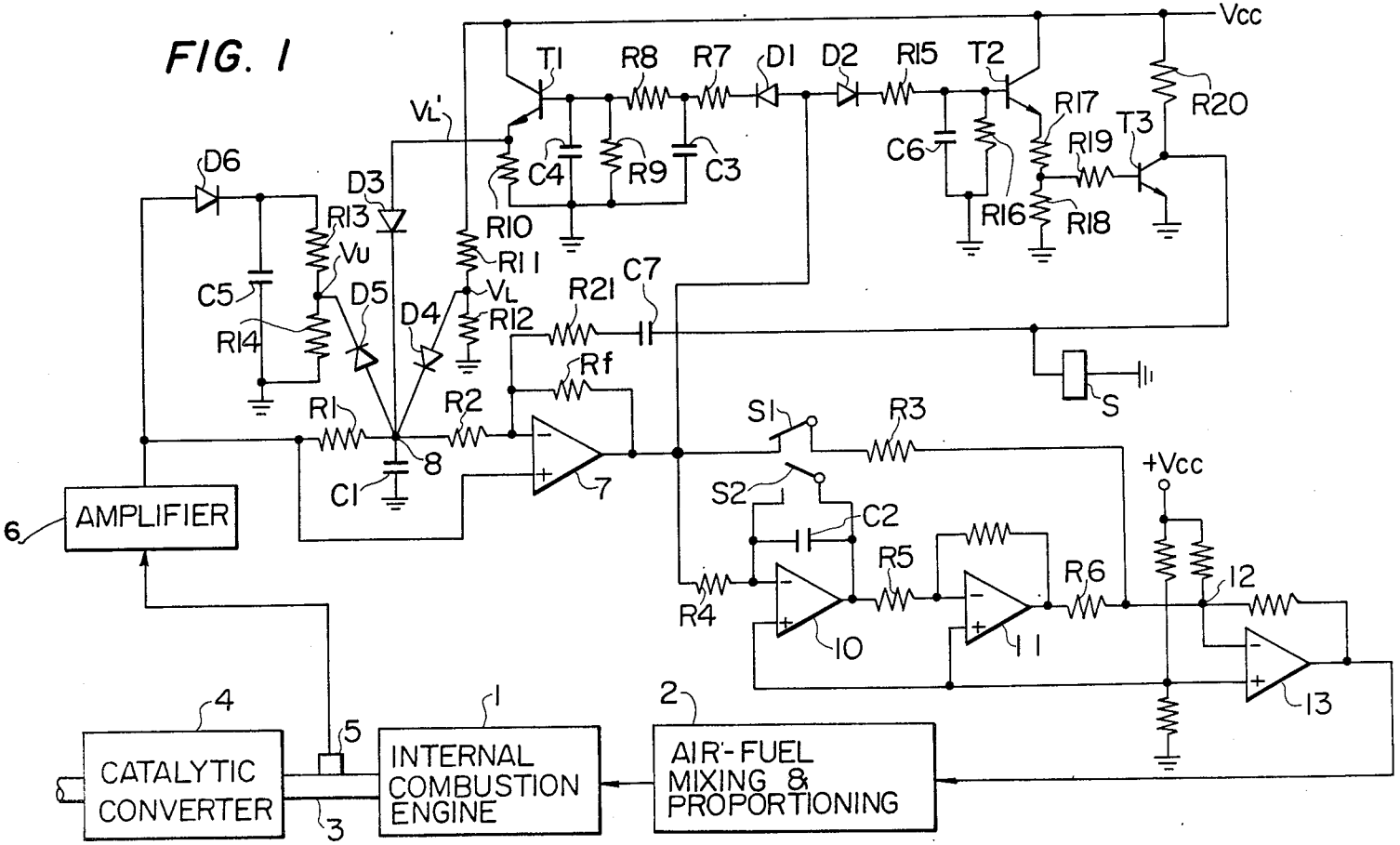
FIG. 1 is a circuit diagram of an embodiment of the invention.

Referring to FIG. 1, an internal combustion engine 1 is supplied with a mixture of fuel and air through appropriate conventional air-fuel mixing and proportioning means 2 (carburetor or fuel injection). Engine 1 exhausts its spent gases through an exhaust conduit 3 including a catalytic converter 4. Catalytic converter 4 is a device of the type in which exhaust gases flowing therethrough are exposed to a catalytic substance which, given the proper air-fuel ratio in the exhaust gases, will promote simultaneous oxidation of carbon monoxide and hydrocarbons and reduction of oxides of nitrogen. Exhaust conduit 3 is provided with an oxygen sensor 5 upstream from catalytic converter 4. Oxygen sensor 5 is preferably of the zirconia electrolyte type which, when exposed to engine exhaust gases at high temperatures, generate an output voltage which changes appreciably as the air-fuel ratio of the exhaust gases passes through the stoichiometric level, and the minimum and maximum levels of the sensor can vary greatly with its temperature.

The signal from oxygen sensor 5 is fed into a DC amplifier 6 which supplies an amplified oxygen sensor signal to the noninverting input of an operational amplifier 7 for comparison with a reference voltage fed to the inverting input. The reference voltage is obtained from an averaging circuit which averages out the fluctuation of input voltage to representative a time integral of the oxygen sensor output. The averaging circuit is formed by a resistor R1 coupled to amplifier 6 and a capacitor C1 connected between resistor R1 and ground to develop an integrated voltage thereacross representing the time integral of the oxygen sensor output.

The inverting input of operational amplifier 7 is connected to a junction point 8 by a resistor R2 and further coupled to the output by a feedback resistor Rf having an appropriate value so that the operational amplifier 7 acts as a comparator providing an output at one of two discrete values depending upon whether the amplifier 6 output is above or below the reference voltage applied to its inverting input. The resistance value of feedback resistor Rf is chosen in consideration of the operating characteristic of the later stage which includes proportional and integral control circuitry.

The output from the comparator 7 is coupled to a proportional controller formed by a circuit including a normally closed relay contacts S1 and a resistor R3, and also to an integral controller formed by operational amplifiers 10 and 11. The inverting input of operational amplifier 10 is coupled to the output of comparator 7 by a resistor R4 and also to its output by an integrating capacitor C2 which is parallel connected with a normally open relay contacts S2. The output of amplifier 10 is in turn connected by a resistor R5 to the inverting input of the amplifier 11. Amplifier 11 serves to invert the polarity of the input voltage so that its output is in phase with the output from the proportional controller. The output of amplifier 11 is coupled by a resistor R6 to the summing junction 12 of a summation amplifier 13. To the summing junction 12 is also coupled the resistor R3 of proportional controller so that the output from summation amplifier 13 is a summation of the integration and proportioning of the sensed oxygen content in the exhaust gases and used to drive the air-fuel mixing and proportioning device 2.

The output from the comparator 7 is also coupled to the base of a transistor T1 by a circuit including a diode D1 and resistor R7 and R8 connected in series. The junction of resistors R7 and R8 is connected to ground by a capacitor C3, and the base of transistor T1 is connected to ground by a capacitor C4 which is coupled in parallel with a resistor R9. The emitter of transistor T1 is coupled to ground by a resistor R10, the collector being connected to voltage supply Vcc. Capacitors C3 and C4 are charged when the comparator output rises in voltage and provides a bias for the transistor T1. When transistor T1 is conductive, a voltage VL' is developed across the resistor R10 which is coupled to the junction point 8 by a diode D3.

The lower level of the voltage at the junction 8 is clamped to a voltage VL determined by the junction of resistors R11 and R12. The voltage VL is chosen to represent the temperature in the exhaust conduit that warrants the start of closed control operation. The junction of resistors R11 and R12 is coupled by a diode D4 to the junction 8 so that the voltage at junction 8 is maintained at the voltage VL when the time integral of the oxygen sensor output reduces below VL.

The voltage VL' is chosen at a value higher than voltage VL to represent the temperature in the exhaust conduit that warrants the suspension of closed control operation. Once the oxygen sensor is in operative temperature range, the reference voltage at the junction 8 is raised to the voltage level VL' from VL so that VL' is a threshold level for detecting when the closed control operation is to be suspended. Suspension of closed control operation is appropriate when the engine is idled for an extended period of time before the exhaust temperature falls below the sensor operating temperature level VL'.

The voltage at the reference junction point 8 is also clampled to an upper voltage level set by a circuit including series connected resistors R13 and R14, and a diode D5 having its cathode connected to the junction of resistors R13, R14 and its anode connected to the summing junction 8. The resistors R13, R14 are coupled in parallel with a capacitor C5 which is charged by a voltage supplied from the output of amplifier 6 by a diode D6. The voltage across capacitor C5 is thus scaled down in proportion to the ratio of resistor R13 to resistor R14 so as to set up the upper limit voltage VU at the junction of resistors R13, R14. When the reference voltage at point 8 exceeds voltage VU, diode D5 conducts and prevents the reference voltage from becoming higher than the upper limit level VU. Therefore, under normal operating conditions, the voltage level at point 8 varies between lower and upper voltage levels VL' and VU.

The output from the comparator 7 is also connected to the base of a transistor T2 by a circuit including a diode D2 and a resistor R15. The base of transistor T2 is connected to ground by a capacitor C6 coupled in parallel with a resistor R16. The circuit formed by resistor R15 and capacitor C6 is a charging circuit with a smaller time constant value than that of a discharging circuit formed by resistor R16 and capacitor C6. The bias for the transistor T2 sharply rises as the voltage across capacitor C6 develops by the charging current supplied from the output of comparator 7 and decreases gradually in the absence of the charging current. The emitter of transistor T2 is connected to ground by series-connected resistors R17 and R18 and its collector connected to the voltage supply. The base of a transistor T3 is connected to the junction of resistors R17, R18 by a resistor R19. Transistor T3 has its collector connected to the voltage supply by a load resistance R20 and its emitter connected to ground. The collector of transistor T3 is also connected to ground through the winding of a relay S and to the inverting input of the comparator 7 by a differentiator circuit formed by a resistor R21 and a capacitor C7.

Transistors T2 and T3 are simultaneously rendered conductive when the comparator output rises in voltage.

The turn-on of transistor T3 switches the potential at its collector to a low voltage level which de-energizes the relay S. The differentiator circuit R21, C7 differentiates the change in voltage at the collector of transistor T3 when it turns on and provides a negative bias to the inverting input of the comparator 7.

Figure 4:
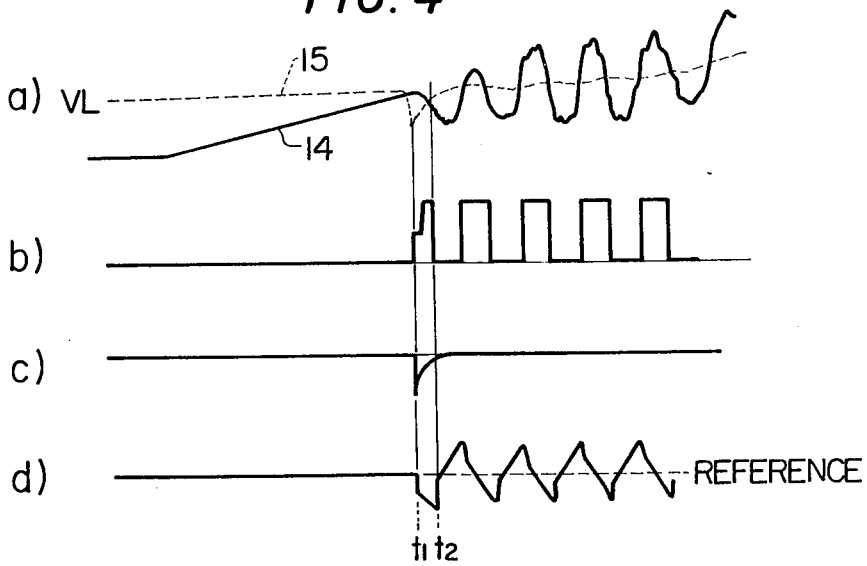
FIG. 4 is a waveform diagram useful for describing the operation of the embodiment of FIG. 1.

In operation, it is assumed that the internal combustion engine 1 is under cold start operation. The sensor voltage under cold start operation remains low. Transistors T2 and T3 are turned off so that the voltage at the collector of transistor T3 is at a high voltage level which energizes relay S to open the contacts S1 and close the contacts S2. Therefore, both proportional and integral signals are disabled and the feedback control is suspended. When the engine has been warmed up and the sensor voltage reaches the lower limit voltage VL at time $t_1$ (a solid line curve 14 in FIG. 4*a*), the output of comparator 7 will jump to a voltage which may be midway between its high and low voltage levels. (FIG. 4*b*) This output is passed through diode D2 and charges capacitor C6 to turn on transistors T2 and T3 simultaneously. The relay S is de-energized to cease the suspension of feedback control. At the same time the inverting input of the comparator 7 is negatively biased by the differentiated pulse (FIG. 4*c*) and results in a lowering of the voltage at the inverting input as indicated by the broken-line curve 15. As a consequence the output of comparator 7 jumps to the high voltage level. This high voltage level is coupled to the proportional and integral controllers so that air-fuel ratio changes in response to the high level output from the comparator 7. This in turn reduces the sensor voltage as shown in FIG. 4*a*. However, the reference potential is lower than the oxygen sensor voltage during time interval $t_1$ to $t_2$, the comparator 7 remains in the high output voltage state until the latter falls below the former at time $t_2$. Therefore, it will be understood that when the oxygen sensor voltage reaches the lower threshold level VL, the feedback control is instantly commenced even though the oxygen sensor voltage tends to stay at the same voltage as its time integral value after the threshold level has been reached.

Once the exhaust gas sensor reaches its operating temperature range, the signal from the comparator 7 produces a voltage across resistor R10 which is coupled to the summing junction 8 via diode D3 so that the potential at the summing junction 8 is raised to the voltage VL′ representing the condition that warrants the suspension of closed control operation and is higher than the operating temperature level VL. If the sensor output falls below the suspension level VL′ and remains there due to a prolonged idling operation, for example, the transistor T3 is switched to the output high state which energizes the relay S so that closed control operation is disabled.

Figure 2:
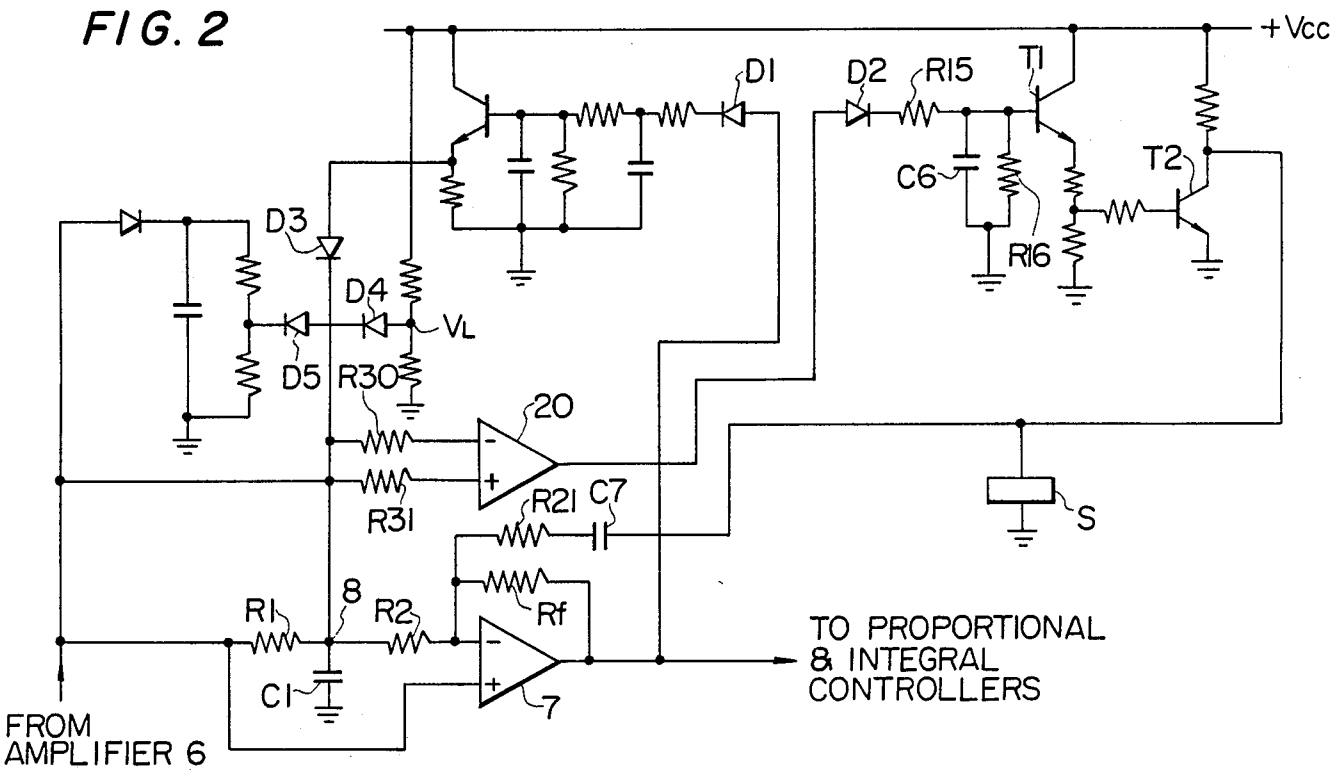
FIG. 2 is an alternative embodiment of the invention.

FIG. 2 illustrates an alternative embodiment of the invention, in which identical parts are numbered with identical numerals to those used in FIG. 1. In FIG. 2 an operational amplifier 20 is provided which is designed to have a higher amplification than that of operational amplifier 7. The inverting input of amplifier or comparator 20 is connected to the summing junction 8 by a resistor R30 and its noninverting input connected to the output of amplifier 6 by a resistor R31, the output comparator 20 being connected to the anode terminal of the diode D2, which in this embodiment is separated from the anode of diode D1. With the higher amplification, comparator 20 provides an output which assumes at one of two discrete levels of higher amplitude depending upon the relative levels of the input signals applied thereto than that provided by the comparator 7.

When the amplifier 6 output rises above the voltage VL, the comparator 20 is switched to a high output state which instantly charges the capacitor C6 to turn on transistors T1 and T2. In a manner identical to that described in the previous embodiment, the collector T2 voltage falls to a low voltage level which is differentiated by resistor R21 and capacitor C7 to provide a negative polarity output which is applied to the inverting input of the comparator 7.

Figure 3:
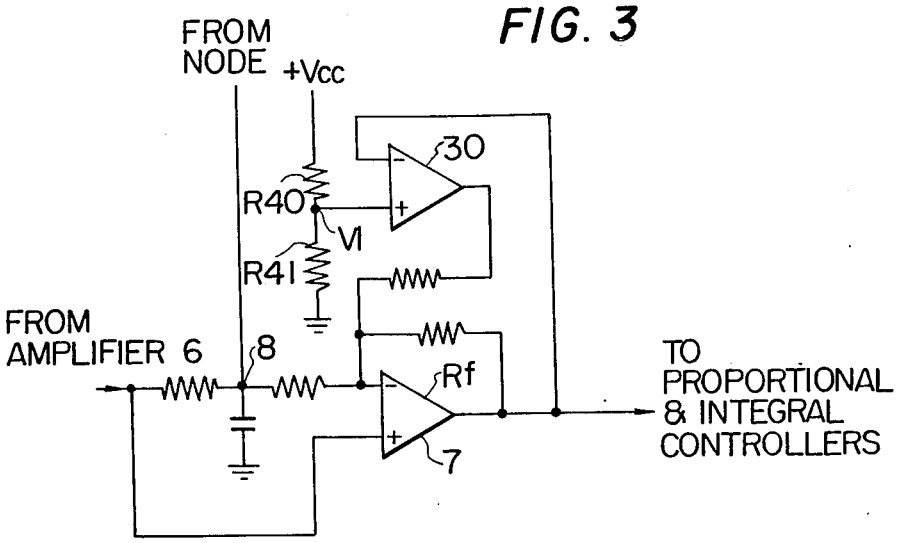
FIG. 3 is a modification of the embodiment of FIG. 1.

FIG. 3 is a modification of the embodiment of FIG. 1. The modification shown in FIG. 3 differs from the embodiment of FIG. 1 in that an operational amplifier or comparator 30 is provided having its inverting input connected to the output of comparator 7 and its noninverting input connected to a voltage source V1 formed by series connected resistors R40, R41. The voltage V1 is chosen at a value lower than the voltage delivered from the comparator 7 when its two input signals assume the same voltage level. The output of comparator 30 is connected to the inverting input of comparator 7 by a resistor R42.

Figure 5:
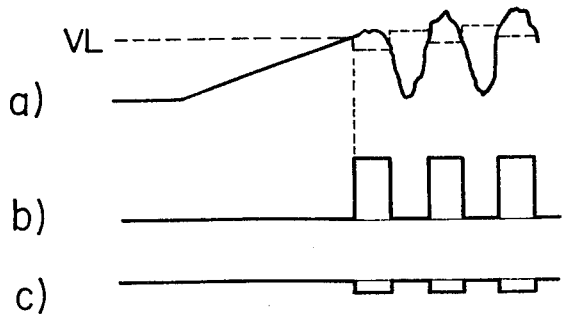
FIG. 5 is a waveform diagram useful for describing the operation of the embodiment of FIG. 3.

When the temperature within the exhaust conduit 3 is below the operating level of oxygen sensor 5, comparator 7 delivers a low level voltage output to the comparator 30 so that the output from the comparator 30 is a high voltage level output which is attenuated by the resistor R42 and applied to the inverting input of the comparator 7. As a result, the combined voltage level at the inverting input of comparator 7 is slightly raised above the voltage at the summing junction 8. It is to be noted that the combined voltage level is chosen to correspond to the lower voltage level VL as referred to above as a sensing threshold level for enabling closed control operation. When the exhaust temperature rises and the amplifier 6 output consequently reaches the combined voltage level at the inverting input, comparator 7 delivers a high voltage level output which causes comparator 30 to change its output state so that the inverting input of comparator 7 slightly falls below the reference voltage VL as illustrated in FIG. 5*a*. Since the sensor output tends to increase, the reduction of reference level at the time of coincidence of two input voltages allows the comparator 7 to deliver a definite voltage signal (FIG. 5*b*) rather than the indeterminate output which is midway between the high and low voltage levels. The potential at the inverting input of comparator 7 is thereafter caused to fluctuate in response to the change in output voltage level. However, the amplitude of this fluctuation is of the order not affecting the reference level of the feedback control operation (FIG. 5*c*).

What is claimed is:

1. In an internal combustion engine including means for supplying air and fuel thereto in variable ratio and exhaust means including a catalytic converter providing simultaneous oxidation of unburned fuel and reduction of nitrogen oxides when supplied with exhaust gases containing air and fuel in a certain ratio, apparatus for controlling the ratio of air and fuel in said exhaust means to said certain ratio, the apparatus comprising:

means for generating a first signal indicative of the air-fuel ratio within said exhaust means upstream from said catalytic converter, said first signal generating means being characterized by temperature-related drift in signal level;

means for developing a first fixed voltage representative of the operating temperature of said first signal generating means;

means for developing a second variable voltage representative of the time integral of the signal from said first signal generating means;

means for comparing said first signal with said first and second reference voltages to provide a first output when said first reference voltage is reached and a second output when said second reference voltage is reached;

means for momentarily generating an offset voltage in response to said first output from said comparing means for offsetting said second reference voltage in a direction opposite to the direction of change in magnitude of said first signal;

means for adjusting said air and fuel supply means to vary the ratio of air and fuel supplied to said engine in response to the direction of the deviation of said first signal from said second reference level to reduce the deviation of the ratio of air and fuel in the exhaust means from said certain ratio; and means for enabling said adjusting means in response to said first output from said comparing means.

2. Apparatus as claimed in claim 1, wherein said offset voltage generating means comprises a charge discharge circuit means for storing the output from said comparing means at a predetermined charging rate and discharging the stored output at a predetermined discharging rate lower than said charging rate, and means for generating a pulse in response to the output from said charge discharge circuit means, said pulse having opposite polarity to the polarity of said second reference voltage, said pulse being combined with said second reference voltage.

3. Apparatus as claimed in claim 2, wherein said pulse generating means comprises a differentiator.

4. Apparatus as claimed in claim 1, wherein said comparing means comprises a first operational amplifier having a first input responsive to said first signal and a second input responsive to said first reference voltage level, and wherein said offset voltage generating means comprises a second operational amplifier with a lower amplification than the amplification of said first operational amplifier and having a first input responsive to said first signal and a second input responsive to said second variable reference voltage, a charge discharge circuit means for storing the output from said first operational amplifier at a predetermined charging rate and discharging the stored output at a predetermined discharging rate lower than said charging rate, and means for generating a pulse in response to the output from said charge discharge circuit means, said pulse having an opposite polarity to said second reference voltage, said pulse being combined with said second reference voltage.

5. Apparatus as claimed in claim 1, wherein said comparing means comprises a first operational amplifier having first and second input terminals connected to receive said first signal and said reference voltage, respectively, and wherein said offset voltage generating means comprises a second operational amplifier having a first input terminal connected to the output of said first operational amplifier and a second input terminal connected to receive a predetermined potential, the output of said second operational amplifier being connected to the second input terminal of said first operational amplifier, the second operational amplifier generating an output which varies in opposition to the variation of said first signal.

6. Apparatus as claimed in claim 1, further comprising means for setting a third fixed reference voltage higher than said first reference voltage, means for comparing said first signal with said third reference voltage to provide a third output when said first signal falls below said third reference voltage, and means for disabling said adjusting means in response to said third output.

7. Apparatus as claimed in claim 6, wherein said means for setting said third reference voltage comprises a charge discharge means responsive to said second output from the first-mentioned comparing means and a transistor biased by an output from said charge discharge means and a resistor connected in the conduction path of said transistor to develop said third reference voltage thereacross.

* * * * *